US008960894B2

(12) United States Patent
Ando

(10) Patent No.: US 8,960,894 B2
(45) Date of Patent: Feb. 24, 2015

(54) INKJET RECORDING APPARATUS WITH DIVIDED BELT TRANSPORT SECTIONS

(71) Applicant: Kyocera Document Solutions Inc., Osaka (JP)

(72) Inventor: Yoshihiro Ando, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/950,428

(22) Filed: Jul. 25, 2013

(65) Prior Publication Data

US 2014/0028770 A1 Jan. 30, 2014

(30) Foreign Application Priority Data

Jul. 27, 2012 (JP) ..... 2012-166691

(51) Int. Cl.

| | |
|---|---|
| ***B41J 2/01*** | (2006.01) |
| ***B41J 13/10*** | (2006.01) |
| ***B41J 13/08*** | (2006.01) |
| ***B41J 15/04*** | (2006.01) |
| ***B41J 11/00*** | (2006.01) |

(52) U.S. Cl.

CPC *B41J 13/10* (2013.01); *B41J 13/08* (2013.01); *B41J 15/048* (2013.01); *B41J 11/007* (2013.01)

USPC ..... 347/104; 347/101

(58) Field of Classification Search

CPC ..... B41J 13/10; B41J 11/007; B41J 13/08; B41J 15/048

USPC ..... 347/104, 101, 32, 22, 37, 8

See application file for complete search history.

(56) References Cited

U.S. PATENT DOCUMENTS

| | | | | |
|---|---|---|---|---|
| 2005/0062793 | A1* | 3/2005 | Takagi et al. | 347/29 |
| 2011/0102530 | A1* | 5/2011 | Yamamoto | 347/104 |

FOREIGN PATENT DOCUMENTS

| | | | |
|---|---|---|---|
| JP | 2003-021941 | A | 1/2003 |
| JP | 2006-327725 | A | 12/2006 |
| JP | 2009-012909 | A | 1/2009 |
| JP | 2009-285952 | A | 12/2009 |
| JP | 2010-052888 | A | 3/2010 |
| JP | 2010-228845 | A | 10/2010 |
| JP | 2011-136468 | A | 7/2011 |

* cited by examiner

*Primary Examiner* — Henok Legesse

(74) *Attorney, Agent, or Firm* — Morgan, Lewis & Bockius LLP

(57) ABSTRACT

An inkjet recording apparatus includes a first belt transport section having a first transport belt, a recording section, a second belt transport section having a second transport belt, and a guide mechanism provided in an upstream-side end part of the second belt transport section. The guide mechanism includes a guide support member and a biasing member. The guide support member has formed therein a guide portion to pass the recording medium held by attraction on the first transport belt to the second transport belt and a positioning portion to keep a fixed gap between the guide portion and the transport surface of the first belt transport section, and is arranged to be swingable in a movement direction of the first belt transport section. The biasing member biases the guide support member in a direction approaching the first belt transport section.

7 Claims, 7 Drawing Sheets

INKJET RECORDING APPARATUS WITH DIVIDED BELT TRANSPORT SECTIONS

INCORPORATION BY REFERENCE

This application is based upon and claims the benefit of priority from the corresponding Japanese Patent Application No. 2012-166691 filed on Jul. 27, 2012, the entire contents of which are incorporated herein by reference.

BACKGROUND

The present disclosure relates to an inkjet recording apparatus which performs recording by ejecting ink onto a recording medium such as sheets of paper.

Recording apparatuses such as facsimile machines, copiers, and printers are designed to record images on recording media such as paper and OHP sheets, and can be classified, according to the recording method they adopt, into an inkjet type, a wire-dot type, a thermal type, and other types. Inkjet recording methods can be classified into a serial type, in which recording is performed while a recording head scans across a recording medium, and a line-head type, in which recording is performed by a recording head, for example, fixed to the body of the recording apparatus.

For example, an inkjet recording apparatus of the line-head type is provided with, for each color it uses, an inkjet head (recording head) of the line-head type in which inkjet nozzles are arranged at predetermined intervals over the entire width of the printing region perpendicular to the transport direction of the recording medium. By ejecting ink from the inkjet nozzles corresponding to the printing position in a fashion coordinated with the transport of the recording medium, printing can be performed over the entire recording medium.

In such inkjet recording apparatuses, in cases where rollers and wheels are used as a means for transporting a recording medium immediately after printing by a recording head, wet ink may deposit on rollers and wheels, and the deposited ink may be transferred back to the recording medium, causing offsetting.

One conceivable way to overcome the inconvenience mentioned above is to transport an inkjet-printed recording medium by use of a transport belt that holds the recording medium on the belt surface by attraction. Here, extending the transport belt in the printing region opposite the recording head toward the downstream side of the printing region results in an increased circumferential length of the transport belt and hence to a larger size of the belt transport portion, leading to increased cost. Moreover, the belt retraction region for the handling of a recording medium jammed in the printing region is then accordingly large, and this hampers making inkjet recording apparatuses compact and space-saving.

As a solution, for example, inkjet recording apparatuses are known in which a transport passage for a recording medium is built with a belt transport section that is divided into a first belt transport section arranged opposite a recording section and a second belt transport section arranged on the downstream side of the recording section.

SUMMARY

According to one aspect of the present disclosure, an inkjet recording apparatus is provided with a first belt transport section, a recording section, a second belt transport section, and a guide mechanism, and the first belt transport section is reciprocally movable in a direction approaching or departing from the recording section. The first belt transport section has a first transport belt which transports a recording medium held by attraction thereon. The recording section is arranged opposite the first belt transport section, and ejects ink onto the recording medium transported by the first transport belt. The second belt transport section is arranged on the downstream side of the first belt transport section next thereto with respect to the transport direction of the recording medium, and has a second transport belt which transports the recording medium held by attraction thereon. The guide mechanism is provided in an upstream-side end part of the second belt transport section with respect to the transport direction of the recording medium, and includes a guide support member and a biasing member. The guide support member has formed therein a guide portion which is arranged close to the transport surface of the first transport belt and which passes the recording medium held by attraction on the first transport belt to the second transport belt and a positioning portion which makes contact with a downstream-side end part of the first belt transport section so as to keep a fixed gap between the guide portion and the transport surface of the first belt transport section, and is arranged so as to be swingable in the movement direction of the first belt transport section. The biasing member biases the guide support member in a direction approaching the first belt transport section.

Further features and advantages of the present disclosure will become apparent from the description of embodiments given below.

DETAILED DESCRIPTION

Figure 1:
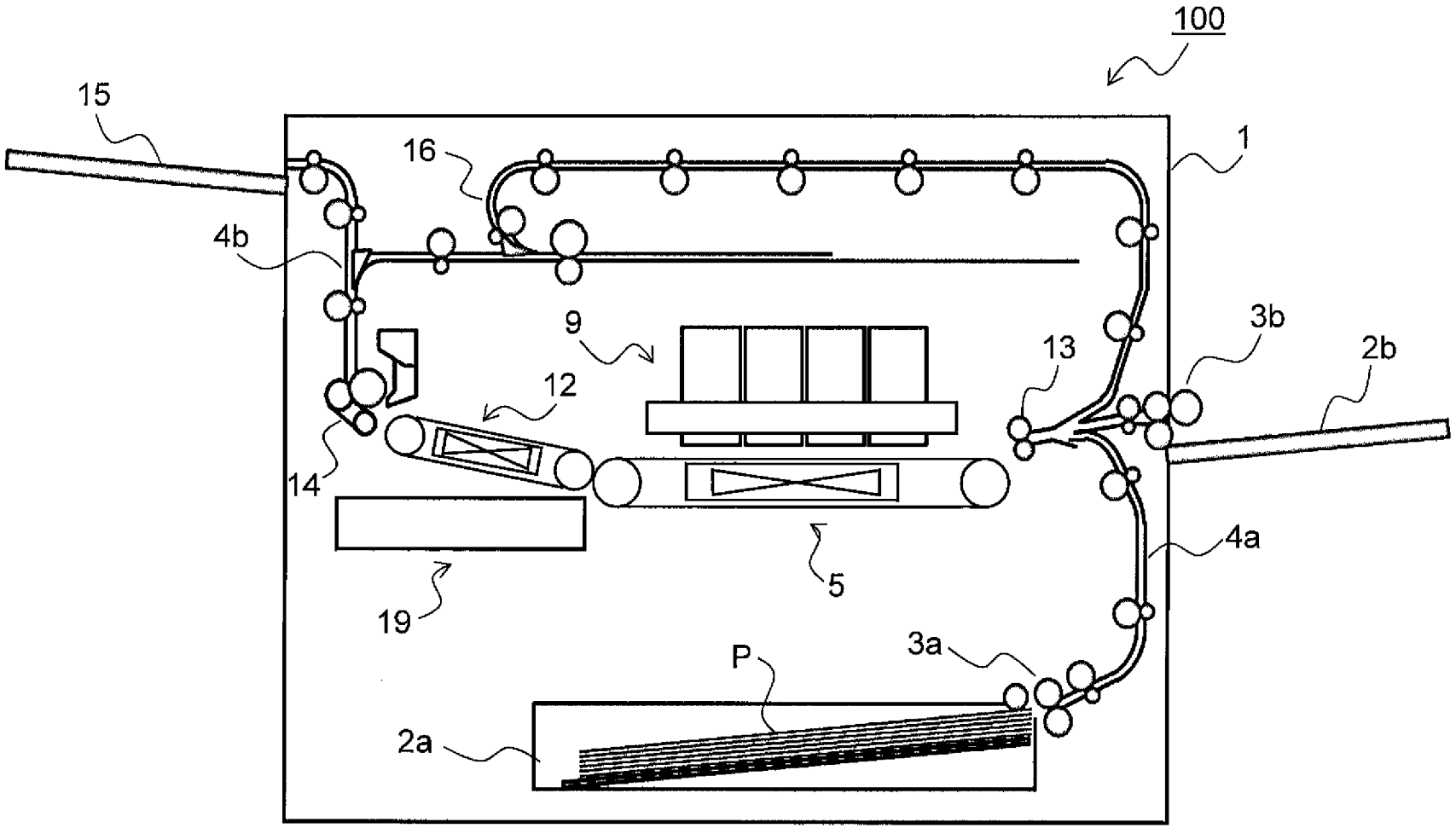
FIG. 1 is a side sectional view showing the inner structure of a printer 100 as one example of an inkjet recording apparatus according to the present disclosure.
Figure 2:
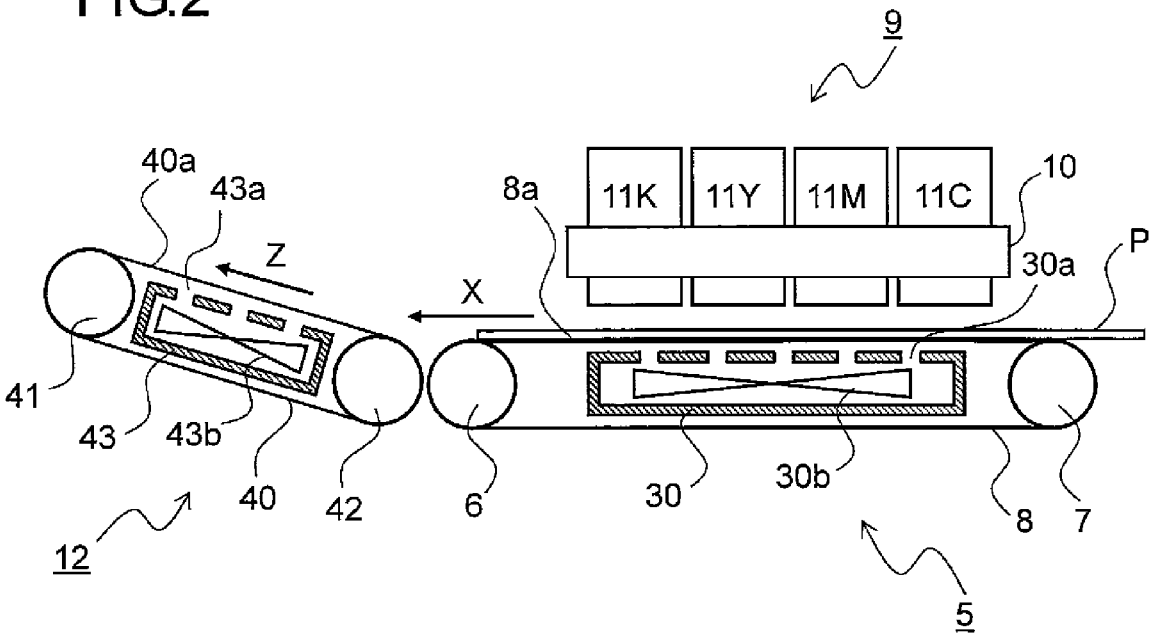
FIG. 2 is a partly enlarged diagram of and around a first belt transport section 5, a recording section 9, and a second belt transport section 12 in the printer 100 shown in FIG. 1.

Hereinafter, an inkjet recording apparatus according to the present disclosure will be described with reference to the accompanying drawings. FIG. 1 is a side sectional view showing the inner structure of an inkjet printer 100 as one example of an inkjet recording apparatus according to the present disclosure. FIG. 2 is a partly enlarged diagram of and around the first belt transport section 5, the recording section 9, and the second belt transport section 12 in FIG. 1.

As shown in FIG. 1, in the inkjet printer 100, in a lower part inside a printer cabinet 1, a sheet feed cassette 2*a* as a sheet containing section is arranged. Inside the sheet feed cassette 2*a*, a predetermined number of (for example, about 500) sheets P, such as unprinted cut paper sheets, as one example of a recording medium, are contained in a stacked state. On the downstream side of the sheet feed cassette 2*a* with respect to the sheet transport direction, that is, on the upper right side of the sheet feed cassette 2*a* in FIG. 1, a sheet feeding device 3*a* is arranged. By the sheet feeding device 3*a*, the sheets P are fed, one sheet after another separately, to the upper right side of the sheet feed cassette 2*a* in FIG. 1. The sheet feed cassette 2*a* can be drawn out of the printer cabinet 1 at its front side for replenishment with sheets P.

At the right side face of the printer cabinet 1, outside it, a hand-feed tray 2*b* is provided. The hand-feed tray 2*b* is for placement thereon of, for example, sheets of a different size from the sheets P inside the sheet feed cassette 2*a*, recording media that are difficult to pass through bent transport paths, such as thick sheets, OHP sheets, envelopes, postcards, and invoices, and recording media that need to be fed in sheet by sheet by hand. On the downstream side of the hand-feed tray 2*b* with respect to the sheet transport direction, that is, on the left side of the hand-feed tray 2*b* in FIG. 1, a sheet feeding device 3*b* is arranged. By the sheet feeding device 3*b*, sheets on the hand-feed tray 2*b* are fed out, one sheet after another separately, leftward in FIG. 1.

The inkjet printer 100 is further provided with, inside it, a first sheet transport passage 4*a*. The first sheet transport passage 4*a* is located on the upper right side of the sheet feed cassette 2*a*, that is, in its sheet feed direction, and is located on the left side of the hand-feed tray 2*b*. A sheet P fed out of the sheet feed cassette 2*a* is transported through the first sheet transport passage 4*a*, vertically upward along a side face of the printer cabinet 1. A sheet fed out of the hand-feed tray 2*b* is transported substantially horizontally leftward.

At the downstream end of the first sheet transport passage 4*a* with respect to the sheet transport direction, a registration roller pair 13 is provided. On the downstream side of the registration roller pair 13, close to it, a first belt transport section 5 and a recording section 9 are arranged. A sheet P fed out of the sheet feed cassette 2*a* (or the hand-feed tray 2*b*) passes through the first sheet transport passage 4*a* and reaches the registration roller pair 13. The registration roller pair 13 corrects oblique feeding of the sheet P, and feeds the sheet P forward toward the first belt transport section 5 with timing coordinated with the inkjet operation performed by the recording section 9. In the first sheet transport passage 4*a*, transport roller pairs for transporting the sheet P are provided wherever appropriate.

The first belt transport section 5 is provided with a first transport belt 8, which is endless and is wound across a first driving roller 6 and a first following roller 7. The first transport belt 8 rotates in the counter-clockwise direction in FIG. 2 by being driven by the first driving roller 6. The sheet P fed forward by the registration roller pair 13 is held on the transport surface 8*a* (the top face in FIG. 2) of the first transport belt 8, and is transported in the direction indicated by arrow X (from right to left) in FIG. 2. In addition to the first driving roller 6 and the first following roller 7, one or more tension rollers that make contact with the first transport belt 8 from inside may be provided as necessary.

Inside the first transport belt 8, at a position opposite the surface of the first transport belt 8 reverse to the transport surface 8*a*, a first sheet suction section 30 is provided. The first sheet suction section 30 has a large number of holes 30*a* for air suction formed in its top face, is provided with a fan 30*b* inside, and can suck air down through the top face. The first transport belt 8 also has a large number of ventilation holes (not shown) for air suction formed in it. With this structure, the first belt transport section 5 transports the sheet P in a state held by attraction on the transport surface 8*a* of the first transport belt 8.

The recording section 9 is provided with line heads 11C, 11M, 11Y, and 11K which record images on the sheet P transported in a state held by attraction on the transport surface 8*a*. According to information containing image data received from an external computer or the like, from the line heads 11C to 11K, ink of the respective colors is sequentially ejected onto the sheet P held by attraction on the first transport belt 8. This causes a full-color image having ink of four colors, namely yellow, magenta, cyan, and black, overlapped together to be recorded on the sheet P. The inkjet printer 100 can also record a monochrome image.

Moreover, in the recording section 9, to prevent inkjet failure due to drying up or clogging in recording heads 17*a* to 17*c* (see FIG. 3), purging is performed as necessary. Purging is an operation for expelling ink with increased viscosity inside nozzles, and is performed with respect to, when printing is started after a long period of inoperativeness, the inkjet nozzles 18 (see FIG. 3) of all the recording heads 17*a* to 17*c* and, during intermissions in printing, any inkjet nozzle 18 through which less than a prescribed amount of ink has been discharged, in preparation for the subsequent printing operation.

On the downstream side (left side in FIG. 1) of the first belt transport section 5 with respect to the sheet transport direction, a second belt transport section 12 is arranged. The sheet P having ink images formed on it in the recording section 9 is fed on to the second belt transport section 12, and while it passes through the second belt transport section 12, the ink ejected onto the surface of the sheet P is dried.

The second belt transport section 12 is provided with a second transport belt 40 which is endless and is wound across a second driving roller 41 and a second following roller 42. The second transport belt 40 rotates in the counter-clockwise direction in FIG. 2 by being driven by the second driving roller 41. The sheet P having images formed on it by the recording section 9 and transported in the direction indicated by arrow X by the first belt transport section 5 is passed to the second transport belt 40 to be transported in the direction indicated by arrow Z in FIG. 2. In addition to the second driving roller 41 and the second following roller 42, one or more tension rollers that make contact with the second transport belt 40 from inside may be provided as necessary.

Inside the second transport belt 40, at a position opposite the surface of the second transport belt 40 reverse to its transport surface 40*a*, a second sheet suction section 43 is provided. The second sheet suction section 43 has a large number of holes 43*a* for air suction formed in its top face, is provided with a fan 43*b* inside, and can suck air down through the top face. The second transport belt 40 also has a large number of ventilation holes 40*b* (see FIG. 9) for air suction formed in it. With this structure, the second belt transport section 12 transports the sheet P in a state held by attraction on the transport surface 40*a* of the second transport belt 40.

On the downstream side of the second belt transport section 12 with respect to the sheet transport direction, near the left side face of the printer cabinet 1, a decurler section 14 is provided. The sheet P having the ink dried in the second belt transport section 12 is fed to the decurler section 14, where curl in the sheet P is corrected by use of a plurality of rollers arranged in the sheet width direction.

On the downstream side (upper side in FIG. 1) of the decurler section 14 with respect to the sheet transport direction, a second sheet transport passage 4*b* is provided. The sheet P having passed through the decurler section 14 is, unless subjected to double-side recording, fed through the second sheet transport passage 4*b* so as to be ejected via an ejection roller pair onto a sheet ejection tray 15 which is provided at the left side face of the inkjet printer 100 outside it.

Under the second belt transport section 12, a maintenance unit 19 is arranged. When the purging mentioned above is performed, the maintenance unit 19 moves to under the recording section 9, where the maintenance unit 19 wipes out and collects the ink expelled from the inkjet nozzles 18 (see FIG. 3) of the recording heads 17.

In an upper part of the printer cabinet 1, over the recording section 9 and the second belt transport section 12, a switchback transport passage 16 is provided. When double-side printing is performed, the sheet P having undergone recording on the first side and having passed through the second belt transport section 12 and the decurler section 14 is passed through the second sheet transport passage 4*b* to be fed to the switchback transport passage 16. When the sheet P is fed into the switchback transport passage 16, the sheet transport direction is switched for printing on the second side so that the sheet P then passes through an upper part of the printer cabinet 1 rightward then through the first sheet transport passage 4*a* and the registration roller pair 13 so as to be fed once again, with the second side up, to the first belt transport section 5. In the second sheet transport passage 4*b* and in the switchback transport passage 16, as in the first sheet transport passage 4*a*, transport roller pairs for transporting the sheet P are provided at appropriate places.

Figure 3:
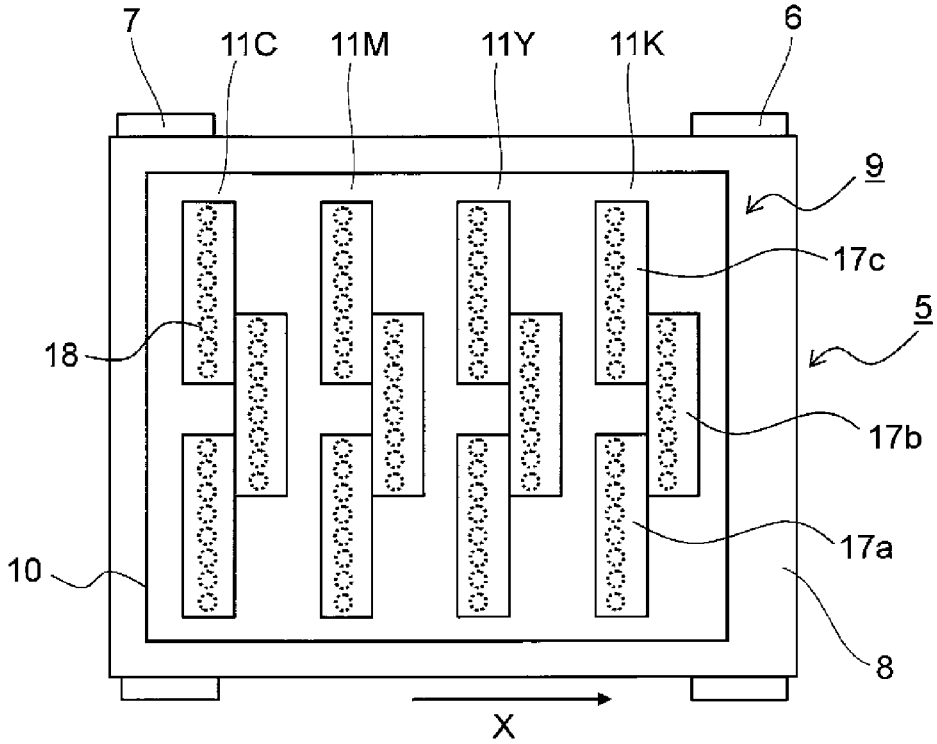
FIG. 3 is a plan view, as seen from above, of the first belt transport section 5 and the recording section 9 in the printer 100 shown in FIG. 1.
Figure 4:
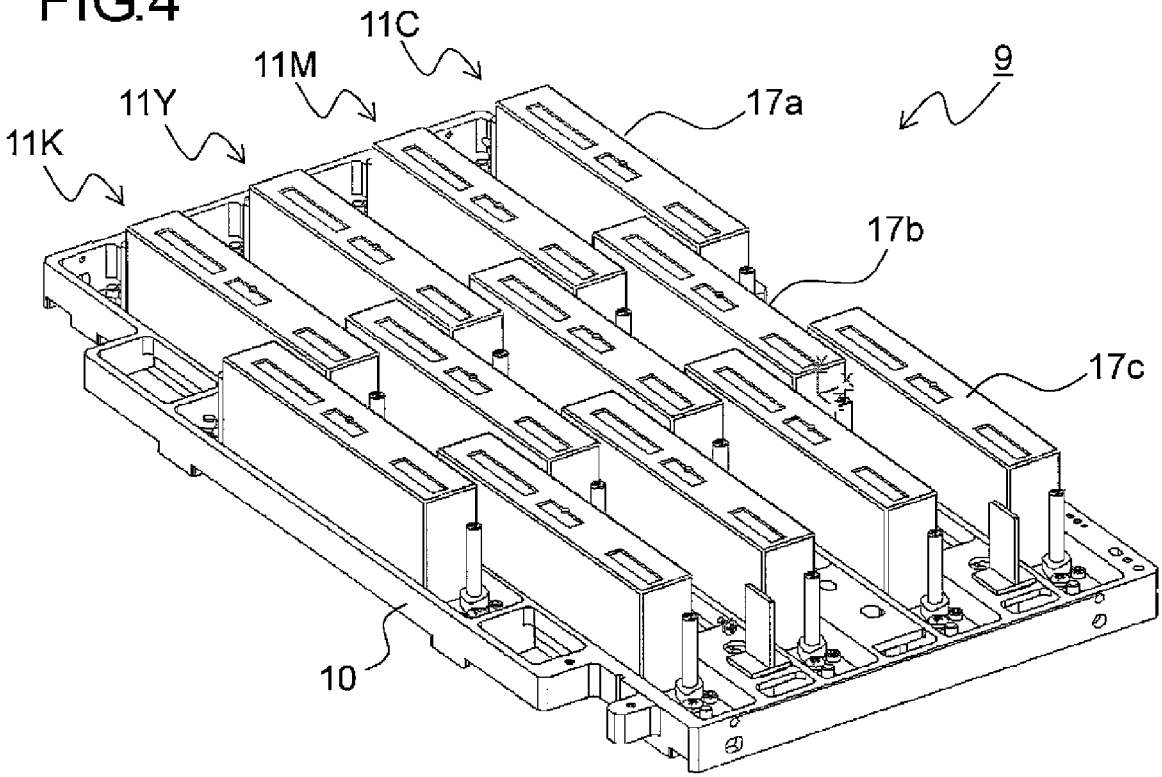
FIG. 4 is a perspective view of the recording section 9 in the printer 100 as seen from obliquely above.
Figure 5:
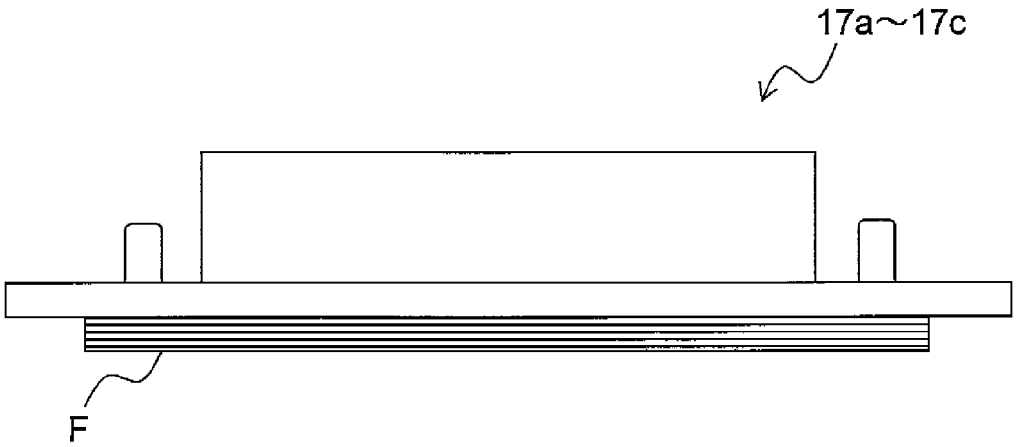
FIG. 5 is a side view of recording heads 17*a* to 17*c* constituting line heads 11C to 11K of the recording section 9.
Figure 6:
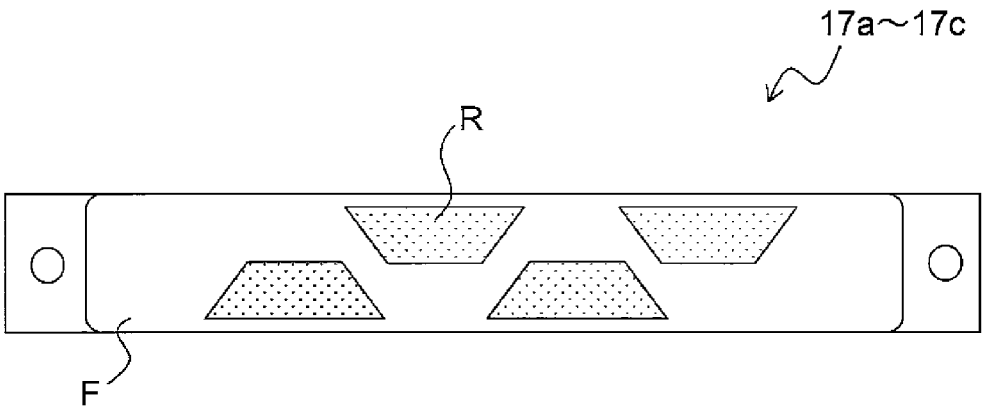
FIG. 6 is a plan view of the recording heads 17*a* to 17*c* as seen from the inkjet surface F side.

FIG. 3 is a plan view, as seen from above, of the first belt transport section 5 and the recording section 9 in the inkjet printer 100 shown in FIG. 1. FIG. 4 is a perspective view of the recording section 9 as seen from obliquely above. FIG. 5 is a side view of the recording heads 17*a* to 17*c* constituting the line heads 11C to 11K of the recording section 9. FIG. 6 is a plan view of the recording heads 17*a* to 17*c* as seen from the inkjet surface F side. It should be noted that FIG. 3 shows the recording section 9 as seen from the back side of FIG. 1 and accordingly, in FIG. 3, the line heads 11C to 11K are shown the other way around than in FIGS. 1 and 2. The recording heads 17*a* to 17*c* all have the same shape and the same structure, and accordingly, in FIGS. 5 and 6, the recording heads 17*a* to 17*c* are indicated by a single outline.

The recording section 9 is provided with a head housing 10 and line heads 11C, 11M, 11Y, and 11K held on the head housing 10. The line heads 11C to 11K are supported at such a height as to leave a predetermined gap (for example, 1 mm) relative to the transport surface 8*a* of the first transport belt 8, and each include, as shown in FIG. 3, a plurality of (here, three) recording heads 17*a* to 17*c* arrayed in a staggered arrangement along the sheet width direction (up/down direction in FIG. 3) which is perpendicular to the sheet transport direction. The line heads 11C to 11K have a recording region of which the width is equal to or larger than that of the sheet P transported, and are designed to be capable of ejecting ink from the inkjet nozzles 18 corresponding the printing position.

As shown in FIGS. 5 and 6, on the inkjet surface F of the recording heads 17*a* to 17*c*, nozzle regions R are provided where a large number of inkjet nozzles 18 are arranged. Moreover, as shown in FIGS. 3 and 4, the three recording heads 17*a* to 17*c* constituting the same one of the line heads 11C to 11K are arranged with end parts overlapping with one another so that part of the inkjet nozzles 18 provided in the recording heads 17*a* to 17*c* overlap with one another in the sheet transport direction.

Figure 7:
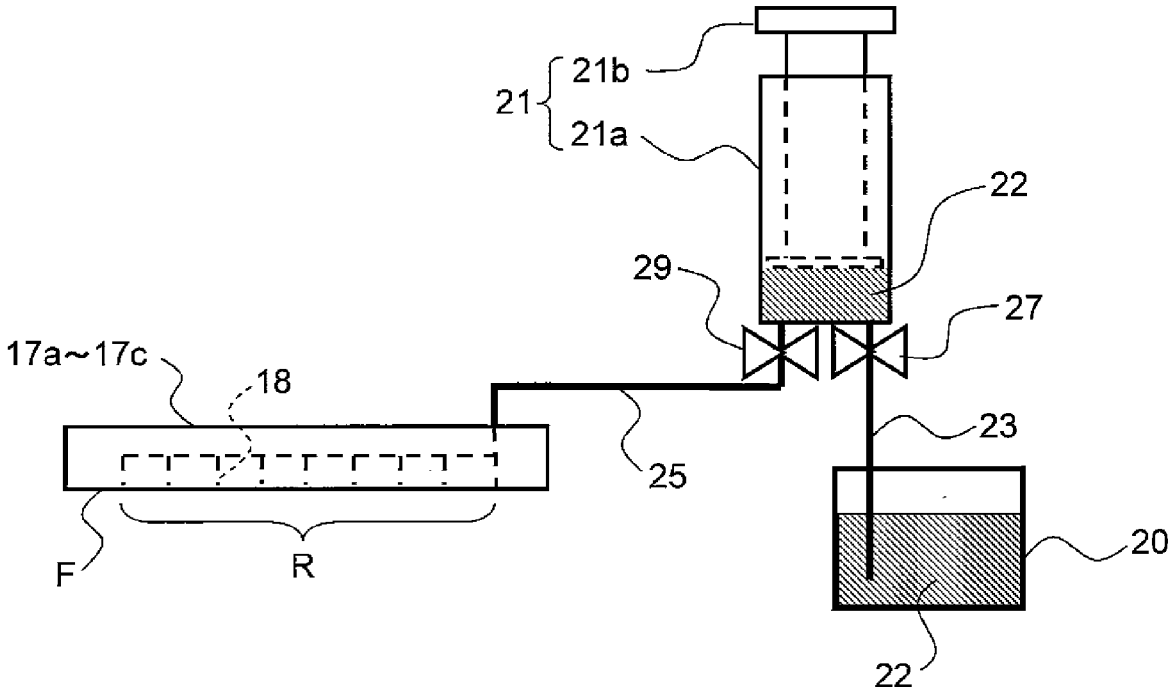
FIG. 7 is a diagram schematically showing the ink path from ink tanks 20 to the recording heads 17*a* to 17*c* in the printer 100.

The recording heads 17*a* to 17*c* constituting the line heads 11C to 11K are respectively supplied with ink of four colors (cyan, magenta, yellow, and black) that are respectively stored in ink tanks 20 (see FIG. 7).

According to image data received from an external computer or the like, the recording heads 17*a* to 17*c* eject ink from the inkjet nozzles 18 toward the sheet P transported in a state held by attraction on the transport surface 8*a* of the first transport belt 8. As a result, on the sheet P on the first transport belt 8, a color image is formed that has ink of four colors, namely cyan, magenta, yellow, and black, overlapped together.

Moreover, to prevent inkjet failure due to drying up or clogging in the recording heads 17*a* to 17*c* (see FIG. 3), purging is performed as necessary. Purging is an operation for expelling ink with increased viscosity inside the nozzles, and is performed with respect to, when printing is started after a long period of inoperativeness, the inkjet nozzles 18 of all the recording heads 17*a* to 17*c* and, during intermissions in printing, any inkjet nozzle 18 through which less than a prescribed amount of ink has been discharged, in preparation for the subsequent printing operation.

The ink may be ejected from the recording heads 17*a* to 17*c* by any method, for example, by a piezoelectric method whereby ink is pushed out by use of unillustrated piezoelectric elements, or by a thermal inkjet method whereby ink is ejected under pressure applied by bubbles produced by heating elements.

Next, a description will be given of how ink is supplied from the ink tanks 20 to the recording heads 17*a* to 17*c* during printing and how ink is expelled from the recording heads 17*a* to 17*c* during purging. FIG. 7 is a diagram schematically showing the ink flow path from the ink tanks 20 to the recording heads 17*a* to 17*c* in the inkjet printer 100. Although in practice the ink flow path shown in FIG. 7 is provided between each of the ink tanks 20 and the corresponding one of the recording heads 17*a* to 17*c*, the following description discusses the ink path for one arbitrary color only.

As shown in FIG. 7, between an ink tank 20 and a recording head 17*a*, 17*b*, or 17*c*, a syringe pump 21 is arranged. The ink tank 20 and the syringe pump 21 are coupled together through a first supply passage 23 formed of a tubular member, and the syringe pump 21 and the inkjet nozzle 18 within the recording head 17*a*, 17*b*, or 17*c* are coupled together through a second supply passage 25 formed of a tubular member.

The first supply passage 23 is provided with an inflow valve 27, and the second supply passage 25 is provided with an outflow valve 29. Opening and closing the inflow valve 27 permits and restricts, respectively, the movement of ink through the first supply passage 23. Opening and closing the outflow valve 29 permits and restricts, respectively, the movement of ink through the second supply passage 25.

The syringe pump 21 is provided with a cylinder 21*a* and a piston 21*b*. The cylinder 21*a* is connected to the first and second supply passages 23 and 25. Thus, through the first supply passage 23, the ink 22 inside the ink tank 20 flows into the cylinder 21*a*. On the other hand, the ink is discharged from the cylinder 21*a* through the second supply passage 25, and the discharged ink is supplied to the recording head 17*a*, 17*b*, or 17*c* so as to be ejected from the inkjet nozzles 18 in the nozzle region R on the inkjet surface F.

The piston 21*b* is designed to be movable up and down by being driven by a driving device (not shown). Around the outer circumference of the piston 21*b*, a gasket (not shown) such as an O-ring is fitted. This provides a design that prevents leakage of ink out of the cylinder 21*a*, and in addition allows smooth sliding of the piston 21*b* across the inner circumferential surface of the cylinder 21*a*.

Ordinarily (during printing), as shown in FIG. 7, the inflow valve 27 and the outflow valve 29 are both open. Thus, with the piston 21*b* at rest at a previously set position, the cylinder 21*a* contains approximately a fixed amount of ink. The surface tension (meniscus) between the cylinder 21*a* and the recording head 17*a*, 17*b*, or 17*c* causes the ink 22 to be supplied from the cylinder 21*a* to the recording head 17*a*, 17*b*, or 17*c*.

Figure 8:
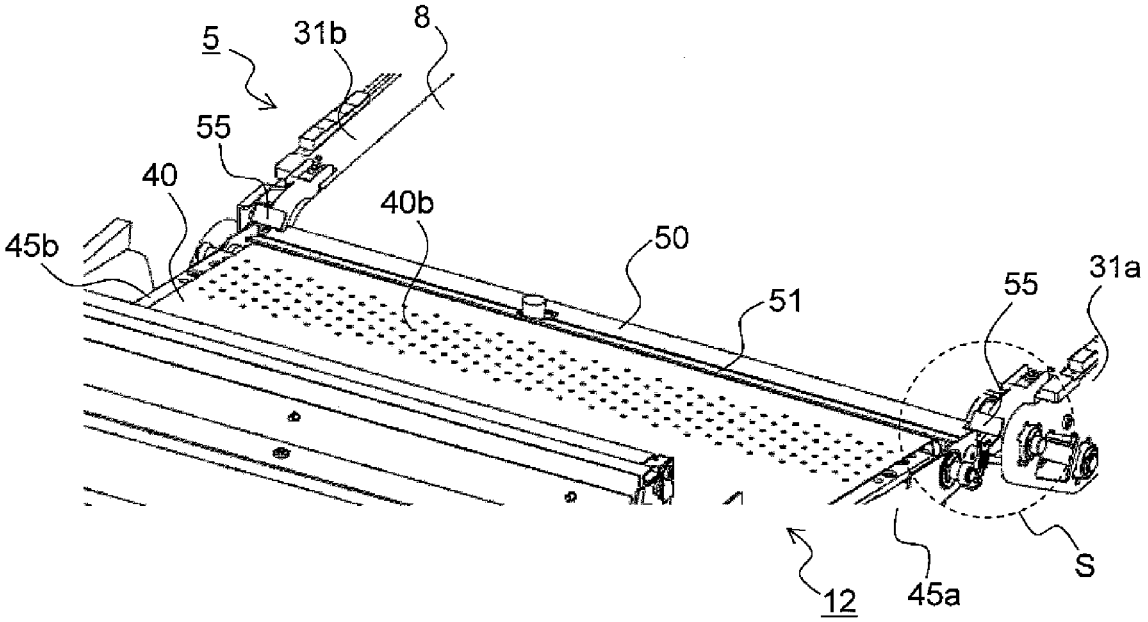
FIG. 8 is a partial perspective view of and around a linking portion between the first belt transport section 5 and the second belt transport section 12 as seen from above.
Figure 9:
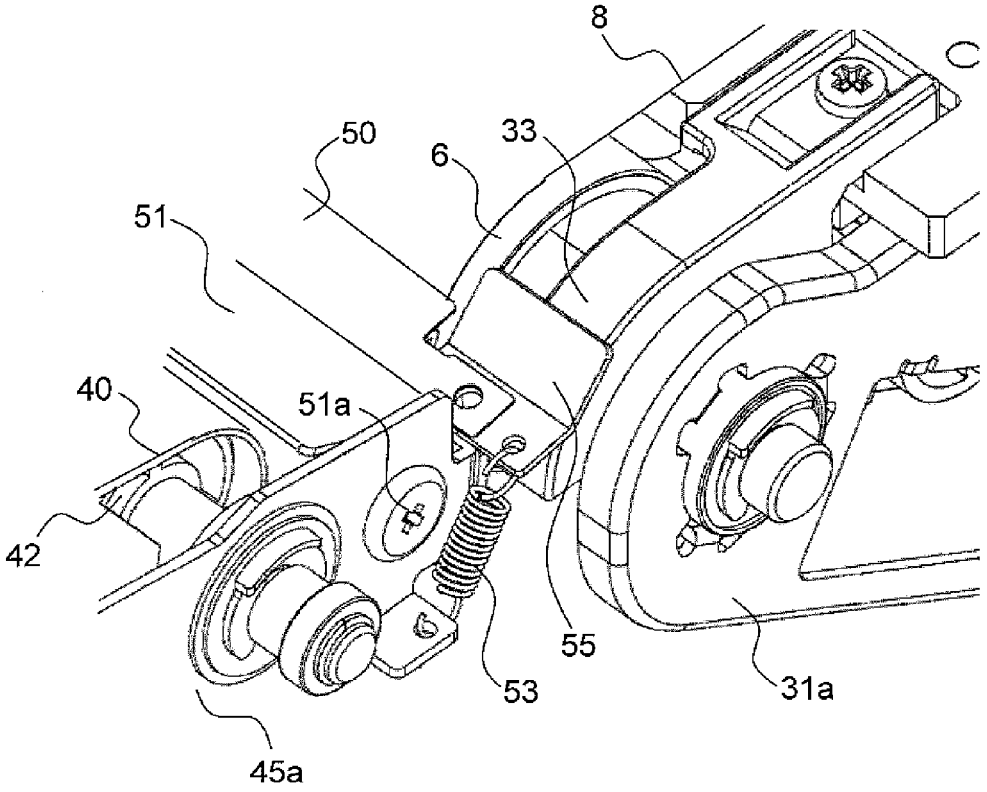
FIG. 9 is an enlarged view of and around a positioning portion 55 of a sheet guide support member 51 in FIG. 8.
Figure 10:
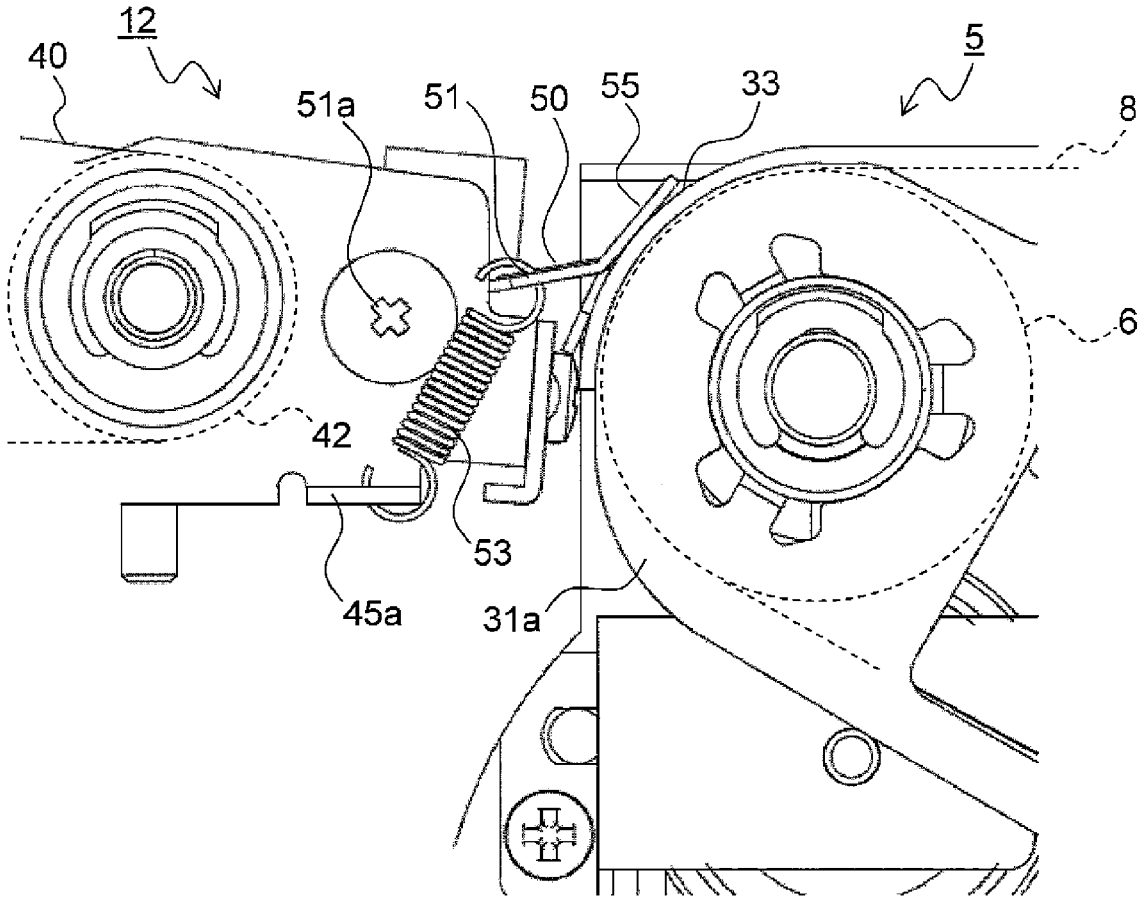
FIG. 10 is an enlarged side view of and around a linking portion between the first belt transport section 5 and the second belt transport section 12.

FIG. 8 is a partial perspective view of and around a linking portion between the first belt transport section 5 and the second belt transport section 12 as seen from above. FIG. 9 is an enlarged view of and around a positioning portion 55 of a sheet guide support member 51. FIG. 10 is an enlarged side view of and around a linking portion between the first belt transport section 5 and the second belt transport section 12. In the first belt transport section 5, between a pair of side plate frames 31*a* and 31*b*, the first driving roller 6 and the first following roller 7 (see FIG. 2) are supported, across which the endless first transport belt 8 is wound. In the second belt transport section 12, between a pair of side plate frames 45*a* and 45*b*, the second driving roller 41 (see FIG. 2) and the second following roller 42 are supported, across which the endless second transport belt 40 is wound.

In an upstream-side (the first belt transport section 5 side) end part of the second belt transport section 12 with respect to the sheet transport direction, a sheet guide portion 50 is provide which separates a sheet held by attraction on the first transport belt 8 to pass it to the second transport belt 40. The sheet guide portion 50 is formed of a thin plate of metal, and has one side edge in its longer-side direction arranged close to the first transport belt 8, so that the leading end of the sheet held by attraction on the first transport belt 8 is separated along the sheet guide portion 50 so as to be smoothly passed to the second transport belt 40.

The sheet guide portion 50 is fixed to a sheet guide support member 51 which is supported like a bridge between the side plate frames 45*a* and 45*b*. The sheet guide support member 51 is formed by bending sheet metal thicker than the sheet guide portion 50, and is supported so as to be swingable about a pivot 51*a* relative to the side plate frames 45*a* and 45*b*. Between the sheet guide support member 51 and the side plate frame 45*a*, a tension spring 53 is coupled.

The sheet guide support member 51 is biased by the tension spring 53 in the clockwise direction (the direction approaching the first belt transport section 5) in FIG. 10 about the pivot 51*a*. In each end part of the sheet guide support member 51, a positioning portion 55 is formed which makes contact with a contact portion 33 of the side plate frame 31*a* or 31*b* of the first belt transport section 5.

Figure 11:
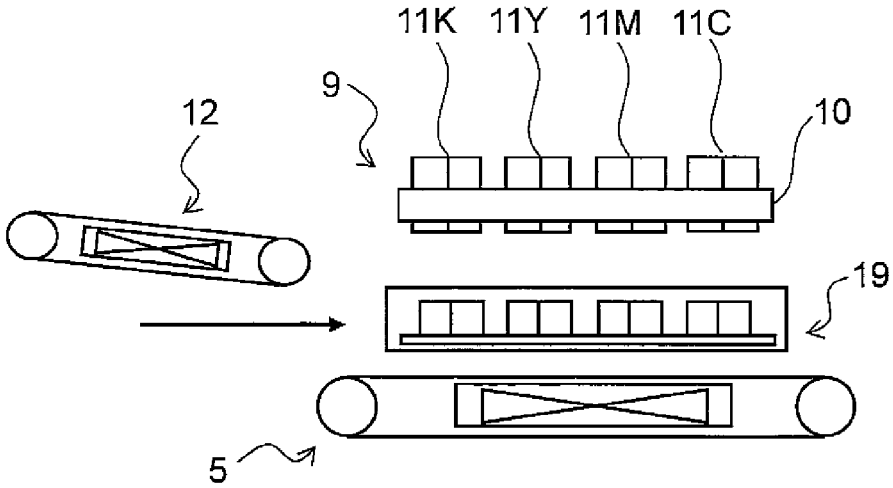
FIG. 11 is a side view of a maintenance unit 19 in a state arranged under the recording section 9.

Next, a description will be given of a recovery operation of the recording heads 17*a* to 17*c* in the inkjet printer 100 according to the present disclosure. FIG. 11 is a side view of the maintenance unit 19 in a state arranged under the recording section 9.

In the recovery operation of the recording heads 17*a* to 17*c*, first, as shown in FIG. 11, the first belt transport section 5 located under the recording section 9 is moved down. Then, the maintenance unit 19 arranged under the second belt transport section 12 is horizontally moved to between the recording section 9 and the first belt transport section 5 so as to be arranged in a position (first position) opposite the recording section 9. In this state, a wiping mechanism (not shown) provided in the maintenance unit 19 is located away from the inkjet surface F of the recording heads 17*a* to 17*c*.

Prior to a wiping operation, while the recording heads 17*a* to 17*c* are not performing printing, the inflow valve 27 (see FIG. 7) is closed, and a pressure is applied to the syringe pump 21 (see FIG. 7) so that the ink 22 inside the cylinder 21*a* is supplied through the second supply passage 25 to the recording heads 17*a* to 17*c*. The supplied ink 22 is forcibly ejected (purging) from the inkjet nozzles 18. Through this purging operation, ink with increased viscosity, foreign matter, and bubbles inside the inkjet nozzles 18 are expelled, and thereby recovery of the recording heads 17*a* to 17*c* is achieved.

Next, a wiping operation is performed to wipe off the ink 22 expelled onto the inkjet surface F. Specifically, by a lifting mechanism (not shown) provided in the maintenance unit 19, the wiping mechanism is moved up. This causes a wiper (not shown) constituting the wiping mechanism to be pressed against the wiping start position on the inkjet surface F of the recording heads 17*a* to 17*c*.

Then, the wiping mechanism is moved horizontally so that the wiper wipes off the ink expelled onto the inkjet surface F. The waste ink wiped off by the wiper is collected in an ink collection tray (not shown) arranged inside the maintenance unit 19.

After the wiper moves to the downstream-side end of the inkjet surface F of the recording heads 17*a* to 17*c*, the wiping mechanism is moved down, so that the wiper is retracted down off the inkjet surface F of the recording heads 17*a* to 17*c*. Thereafter, the wiping mechanism is moved in the direction opposite to the wiping direction, so that the maintenance unit 19 is restored into the original state. The maintenance unit 19 now located in the first position is then horizontally moved to a position (second position) under the second belt transport section 12, and then the first belt transport section 5 is moved up to a predetermined position. This ends the recovery operation of the recording heads 17*a* to 17*c*.

Figure 12:
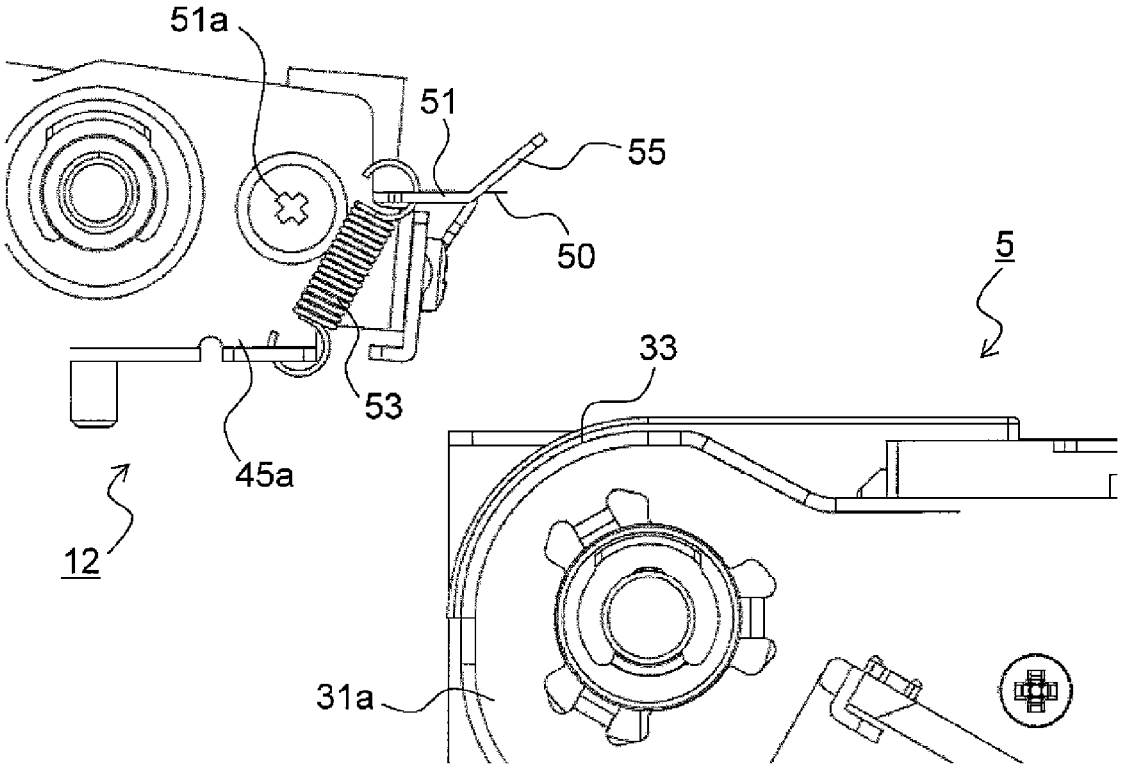
FIG. 12 is an enlarged side view of and around the linking portion between the first belt transport section 5 and the second belt transport section 12, in a state with the first belt transport section 5 lowered.

FIG. 12 is an enlarged side view of and around the linking portion between the first belt transport section 5 and the second belt transport section 12, in a state with the first belt transport section 5 lowered as shown in FIG. 11. In this embodiment, the sheet guide portion 50 located close over the transport surface 8*a* of the first transport belt 8 is provided on the part of the second belt transport section 12. Thus, when the first belt transport section 5 is moved down, and when it is moved up back to the original position, the sheet guide portion 50 does not interfere with the first belt transport section 5. It is thus possible to prevent deformation or breakage of the sheet guide portion 50, and also scratching on the first transport belt 8.

When the first belt transport section 5 is moved up from the state shown in FIG. 12, as shown in FIG. 10, the contact portion 33 of the first belt transport section 5 makes contact with the positioning portion 55 of the sheet guide support member 51. Here, the distance between the transport surface 8*a* of the first transport belt 8 and the inkjet surface F (see FIG. 5) of the recording heads 17*a* to 17*c* may be varied according to the thickness of the sheet P held by attraction on the first transport belt 8. By making adjustable the gap between the transport surface 8*a* of the first transport belt 8 and the recording heads 17*a* to 17*c* of the recording section 9 according to the thickness of the sheet P in this way, it is possible, while keeping the gap between the first transport belt 8 and the sheet guide portion 50 fixed, to keep the gap between the transport surface 8*a* of the first transport belt 8 and the recording section 9 adequate for the thickness of the sheet P.

In general, in inkjet recording apparatuses, with a view to preventing drying up and clogging in inkjet nozzles having apertures provided on the inkjet surface of recording heads, a design is adopted where after ink is ejected from nozzles, the ink deposited on the inkjet surface (nozzle surface) is wiped out with a blade-form wiper and thereby a recovery operation of the recording heads is performed.

In the inkjet printer 100 provided with the first belt transport section 5 arranged opposite the recording section 9 and the second belt transport section 12 arranged on the downstream side of the recording section 9, from the viewpoint of making the inkjet printer 100 compact and space-saving, in a conceivable design, the maintenance unit 19 including the wiper for wiping the inkjet surface and the tray for collecting ink ejected from nozzles is arranged on the downstream side of the first belt transport section 5 with respect to the sheet transport direction.

In that case, after the first belt transport section 5 is moved in the direction departing from (downward) the recording section 9, the maintenance unit 19 is moved to between the recording section 9 and the first belt transport section 5 to perform the recovery operation of the recording heads 17*a* to 17*c*, and on completion of the recovery operation of the recording heads 17*a* to 17*c*, the maintenance unit 19 is retracted to the original position, and the first belt transport section 5 is moved in the direction approaching (upward) the recording section 9.

On the other hand, for smooth passing of a sheet from the first belt transport section 5 to the second belt transport section 12, a guide member needs to be provided close to the belt transport surface of the first belt transport section 5 so as to separate the sheet held by attraction on the first belt transport section 5. In this structure, for the purpose of maintaining a fixed positional relationship between the belt transport surface of the first belt transport section 5 and the guide member, in a conceivable design, the guide member is provided on the part of the first belt transport section 5.

However, with the design described above, when the first belt transport section 5 is moved in the direction departing from the recording section 9, or is returned to the position opposite the recording section 9, the guide member which protrudes from the first belt transport section 5 downstream with respect to the sheet transport direction interferes with the second belt transport section 12, resulting in deformation or breakage of the guide member. To prevent that, a mechanism is required that when the first belt transport section 5 is moved away from the recording section 9, retracts the guide member relative to the second belt transport section 12 and, when the first belt transport section 5 is returned to the position opposite the recording section 9, returns the guide member to the predetermined position. This, disadvantageously, may be considered to complicate the structure.

Moreover, in a case where the distance between the recording section 9 and the sheet transport surface needs to be adjusted according to the thickness of the sheet held by attraction on the first belt transport section 5, changing the position of the first belt transport section 5 results in changing the distance between the guide member and the second belt transport section 12, and this, disadvantageously, may be considered to hamper smooth passing of the sheet from the first belt transport section 5 to the second belt transport section 12.

In this embodiment, the sheet guide support member 51 is swingably provided, and is biased by the tension spring 53 in the direction approaching (the clockwise direction in FIG. 10) the first belt transport section 5. Thus, after the contact portion 33 makes contact with the positioning portion 55, further moving the first belt transport section 5 up causes the sheet guide support member 51 swing in the counter-clockwise direction about the pivot 51*a* against the biasing force of the tension spring 53. Thus, along with the sheet guide support member 51, the sheet guide portion 50 swings in the counter-clockwise direction. This keeps a fixed gap between the first transport belt 8 and the sheet guide portion 50, and allows accurate positioning of the sheet guide portion 50 relative to the transport surface 8*a*.

As described above, owing to the provision of the sheet guide portion 50 in the form of a thin plate which is located close to the first transport belt 8 over substantially the entire region in its width direction, the sheet P can be passed smoothly from the first transport belt 8 to second transport belt 40. Moreover, a pair of positioning portions 55 is kept in contact with a pair of side plate frames 13*a* and 13*b* arranged outside both ends of the first transport belt 8 in its width direction, and the pair of positioning portions 55 can keep a fixed gap between the first transport belt 8 and the sheet guide portion 50 in both end parts of the sheet guide portion 50. Also, the positioning accuracy of the sheet guide portion 50 relative to the transport surface 8*a* of the first transport belt 8 is improved. Although the sheet guide portion 50 and the sheet guide support member 51 are separate members here, these may instead be formed integrally.

Moreover, in this embodiment, the maintenance unit 19 which performs the recovery operation of the recording heads 17*a* to 17*c* provided in the recording section 9 is provided so as to be reciprocally movable between the first position opposite the recording section 9 and the second position retracted from the first position in the direction perpendicular to the movement direction of the first belt transport section 5. The first belt transport section 5 moves in the direction departing from the recording section 9 prior to the movement of the maintenance unit 19 to the first position, and the first belt transport section 5 moves in the direction approaching the recording section 9 after the maintenance unit 19 has moved to the second position. In this way, while interference between the maintenance unit 19 and the first belt transport section 5 during the recovery operation of the recording heads 17*a* to 17*c* is avoided, the gap between the first transport belt 8 and the sheet guide portion 50 can be kept fixed.

In the embodiment described above, when the recovery operation of the recording heads 17*a* to 17*c* is performed, first the maintenance unit 19 is moved to the first position, then, by the lifting mechanism, the wiping mechanism is moved up to the position where the wiper is pressed against the recording heads 17*a* to 17*c*, then the ink expelled from the nozzle and deposited on the inkjet surface is wiped off with the wiper, then the wiping mechanism is moved down to the position where the wiper is away from the recording heads 17*a* to 17*c*, and then the maintenance unit 19 is retracted to the second position. Instead of this design, a design may be adopted where the maintenance unit 19 is moved up and down by use of the up/down movement of the first belt transport section 5 so that the wiping mechanism is moved up and down along with the maintenance unit 19.

Specifically, after the maintenance unit 19 is moved to the first position, the first belt transport section 5 is moved up so that the maintenance unit 19 is lifted up, and the maintenance unit 19 is moved up to the position where the wiper is pressed against the recording heads 17*a* to 17*c*. Then, the ink deposited on the inkjet surface is wiped off with the wiper, and then the first belt transport section 5 is moved down so that the maintenance unit 19 is moved down to the position where the wiper is away from the recording heads 17*a* to 17*c*. Lastly, the maintenance unit 19 is retracted to the second position.

In this way, as the first belt transport section 5 is moved up and down, the wiping mechanism is moved up and down. This eliminates the need to provide the maintenance unit 19 with a mechanism for moving the wiping mechanism up and down, and thus helps simplify the structure.

The present disclosure is in no way limited by the embodiment described above, and allows for many modifications and variations within the spirit of the present disclosure. For example, in the embodiment described above, as a means for holding a sheet P by suction on the first and second transport belts 8 and 40, ventilation holes for air suction are formed in the first and second transport belts 8 and 40, and by use of the first and second sheet suction sections 30 and 43 provided with the fans 30*b* and 43*b* inside, the sheet P is held by attraction, that is, a vacuum attraction method is used. Instead of such a vacuum attraction method, a charging device for electrically charging the first and second transport belts 8 and 40 may be provided to produce a potential difference between the transport surfaces 8*a* and 40*a* of the first and second transport belts 8 and 40 and the sheet P so that the sheet P is electrostatically held by attraction, that is, an electrostatic attraction method may instead be used.

Although the embodiment described above deals with, as an example, an inkjet recording apparatus in which a sheet P is transported horizontally from the sheet feed cassette 2*a* or the hand-feed tray 2*b*, the present disclosure is applicable equally to inkjet recording apparatuses of a vertical transport type where a sheet P is transported from a sheet feed cassette 2*a* or a hand-feed tray 2*b* provided in a lower part of the apparatus toward a sheet ejection tray provided on the top face of the apparatus.

Although the embodiment described above deals with an inkjet recording apparatus that uses ink of four colors, namely yellow, magenta, cyan, and black, the present disclosure is applicable equally to inkjet recording apparatuses provided with ink of different combinations of colors or inkjet recording apparatuses using different numbers of colors.

The present disclosure finds applications in, among recording apparatuses such as facsimile machines, copiers, and printers, inkjet recording apparatuses that achieve recording by ejecting ink onto a recording medium such as sheets of paper. According to the present disclosure, it is possible to provide, with a simple structure, inkjet recording apparatuses where, when the first belt transport section opposite the recording portion is moved up and down, the guide member between the first and second transport sections can be held at a fixed position, and where the recording medium can be passed smoothly regardless of the position of the first belt transport section.

What is claimed is:

1. An inkjet recording apparatus comprising:

a first belt transport section having a first transport belt for transporting a recording medium held by attraction thereon;

a recording section arranged opposite the first belt transport section, for ejecting ink onto the recording medium transported by the first transport belt;

a second belt transport section arranged on a downstream side of the first belt transport section next thereto with respect to a transport direction of the recording medium, the second belt transport section having a second transport belt for transporting the recording medium held by attraction thereon; and a guide mechanism provided in an upstream-side end part of the second belt transport section with respect to the transport direction of the recording medium, the guide mechanism including:

a guide support member having formed therein a guide portion arranged close to a transport surface of the first transport belt so as to pass the recording medium held by attraction on the first transport belt to the second transport belt, and a pair of positioning portions making contact with a downstream-side end part of the first belt transport section, and outside both ends of the first transport belt in a width direction thereof, so as to keep a fixed gap between the guide portion and the transport surface of the first transport belt, the guide support member being arranged so as to be swingable in a movement direction of the first belt transport section; and a biasing member for biasing the guide support member in a direction approaching the first belt transport section, wherein the first belt transport section is reciprocally movable in a direction approaching or departing from the recording section.

2. The inkjet recording apparatus according to claim 1, wherein through reciprocal movement of the first belt transport section, a gap between the transport surface of the first transport belt and the recording section can be adjusted according to a thickness of the recording medium.

3. The inkjet recording apparatus according to claim 2, wherein the guide support member has formed therein, as the guide portion, a guide portion in a form of a thin plate located close to the first transport belt substantially over an entire region in a width direction thereof, and as the positioning portion, a pair of positioning portions provided in contact with a pair of side plate frames arranged outside both ends of the first transport belt in the width direction thereof.

4. The inkjet recording apparatus according to claim 2, wherein a maintenance unit for performing a recovery operation of a recording head provided in the recording section is provided so as to be reciprocally movable between a first position opposite the recording section and a second position retracted from the first position in a direction perpendicular to the movement direction of the first belt transport section, and the first belt transport section moves in the direction departing from the recording section prior to movement of the maintenance unit to the first position, and the first belt transport section moves in the direction approaching the recording medium after the maintenance unit has moved to the second position.

5. The inkjet recording apparatus according to claim 1, wherein in the guide support member, as the guide portion, a guide portion in a form of a thin plate located close to the first transport belt substantially over an entire region in a width direction thereof is formed, and as the positioning portion, a pair of positioning portions provided in contact with a pair of side plate frames arranged outside both ends of the first transport belt in the width direction thereof is formed.

6. The inkjet recording apparatus according to claim 5, wherein a maintenance unit for performing a recovery operation of a recording head provided in the recording section is provided so as to be reciprocally movable between a first position opposite the recording section and a second position retracted from the first position in a direction perpendicular to the movement direction of the first belt transport section, and the first belt transport section moves in the direction departing from the recording section prior to movement of the maintenance unit to the first position, and the first belt transport section moves in the direction approaching the recording medium after the maintenance unit has moved to the second position.

7. The inkjet recording apparatus according to claim 1, wherein a maintenance unit for performing a recovery operation of a recording head provided in the recording section is provided so as to be reciprocally movable between a first position opposite the recording section and a second position retracted from the first position in a direction perpendicular to the movement direction of the first belt transport section, and the first belt transport section moves in the direction departing from the recording section prior to movement of the maintenance unit to the first position, and the first belt transport section moves in the direction approaching the recording medium after the maintenance unit has moved to the second position.

* * * * *